US005619760A

United States Patent [19]

Wang

[11] Patent Number: 5,619,760

[45] Date of Patent: Apr. 15, 1997

[54] DETACHABLE BATHTUB

[76] Inventor: Sung-Shun Wang, 58, Ma Yuan West St., Taichung, Taiwan

[21] Appl. No.: 594,429

[22] Filed: Jan. 31, 1996

[51] Int. Cl.[6] ..... A47K 3/00

[52] U.S. Cl. ..... 4/592; 4/584

[58] Field of Search ..... 4/592, 593, 595, 4/584, 589

[56] References Cited

U.S. PATENT DOCUMENTS

| | | | |
|---|---|---|---|
| 2,841,795 | 7/1958 | Pelicano | 4/592 |
| 4,290,154 | 9/1981 | Benjamin | 4/593 |
| 5,430,898 | 7/1995 | Wang | 4/592 |
| 5,477,568 | 12/1995 | Wang | 4/529 |

*Primary Examiner*—David J. Walczak

[57] ABSTRACT

A detachable bathtub has a bathtub, a side board, and a base beneath the bathtub. The bathtub has an upper flange with posts, an interior and bulges beneath the bathtub. The side board has a peripheral flange with rectangular holes and protrusions disposed thereon. The base has inserted holes thereon, an elongated recess thereunder, and guide blocks disposed at two sides of the base. The elongated recess receives an adjusting block. Each supporting block has a rectangular groove on one side and an inserted groove on the opposite side. The adjusting block is inserted in the elongated recess. The bulges are inserted in the inserted holes. The guide blocks are inserted in the rectangular grooves. The side board abuts one side of the bathtub. The protrusion is pressed into the inserted groove.

1 Claim, 3 Drawing Sheets

DETACHABLE BATHTUB

BACKGROUND OF THE INVENTION

The invention relates to a detachable bathtub. More particularly, the invention relates to a detachable side board of a bathtub.

Referring to FIG. 1, a conventional bathtub 9 has three sides connecting to the walls A. The side board 91 and the bathtub 9 are made in one piece. However, the side board 91 may be located at the left side or the right side of the bathtub 9 according to the arrangement of the bathroom. Therefore, two types of bathtubs 9 should be manufactured by two types of molds. Since the side board 91 and the bathtub 9 are made in one piece, they cannot be detached to replace the broken side board 91 or the broken bathtub 9. U.S. Pat. No. 5,477,568 discloses a side board for a bathtub. However, there are too many elements in U.S. Pat. No. 5,477,568. Thus it is very cumbersome to assemble the side board and the bathtub. It is cumbersome to detach the side board from the bathtub also while the side board or the bathtub is broken.

SUMMARY OF THE INVENTION

An object of the invention is to provide a bathtub with a detachable side board which can be disposed in various bathrooms according to the arrangement of the bathrooms.

Another object of the invention is to provide a detachable bathtub which can be easily assembled or detached.

Accordingly, a detachable bathtub has a bathtub, a side board abutting one side of the bathtub vertically, and a base disposed beneath the bathtub. The bathtub has an upper flange with a plurality of spaced posts thereunder, an interior to contain water, and a plurality of bulges beneath the bathtub. Each post has a central threaded hole. The side board has a peripheral flange with a plurality of spaced rectangular holes thereon, and a plurality of spaced protrusions disposed at the lower portion of the side board. The base has a plurality of inserted holes thereon, an elongated recess thereunder, and a plurality of guide blocks disposed at two sides of the base. The elongated recess receives at least an adjusting block. The height of the block can be varied according to the environmental condition of the bathroom. A plurality of supporting blocks are disposed between the side board and the base. Each of the supporting blocks has a rectangular groove on one side of the supporting block and an inserted groove on the opposite side of the supporting block. When the detachable bathtub is assembled, the adjusting block is inserted in the elongated recess. The bulges are inserted in the corresponding inserted holes. The guide blocks are inserted in the corresponding rectangular grooves. The upper portion of the peripheral flange is disposed beneath the upper flange. A screw passes through the rectangular hole and screw in the central threaded hole of the post to fasten the side board and the bathtub together. The protrusion is pressed into the corresponding inserted groove to fasten the side board and the supporting block together.

DETAILED DESCRIPTION OF THE INVENTION

Figure 1:
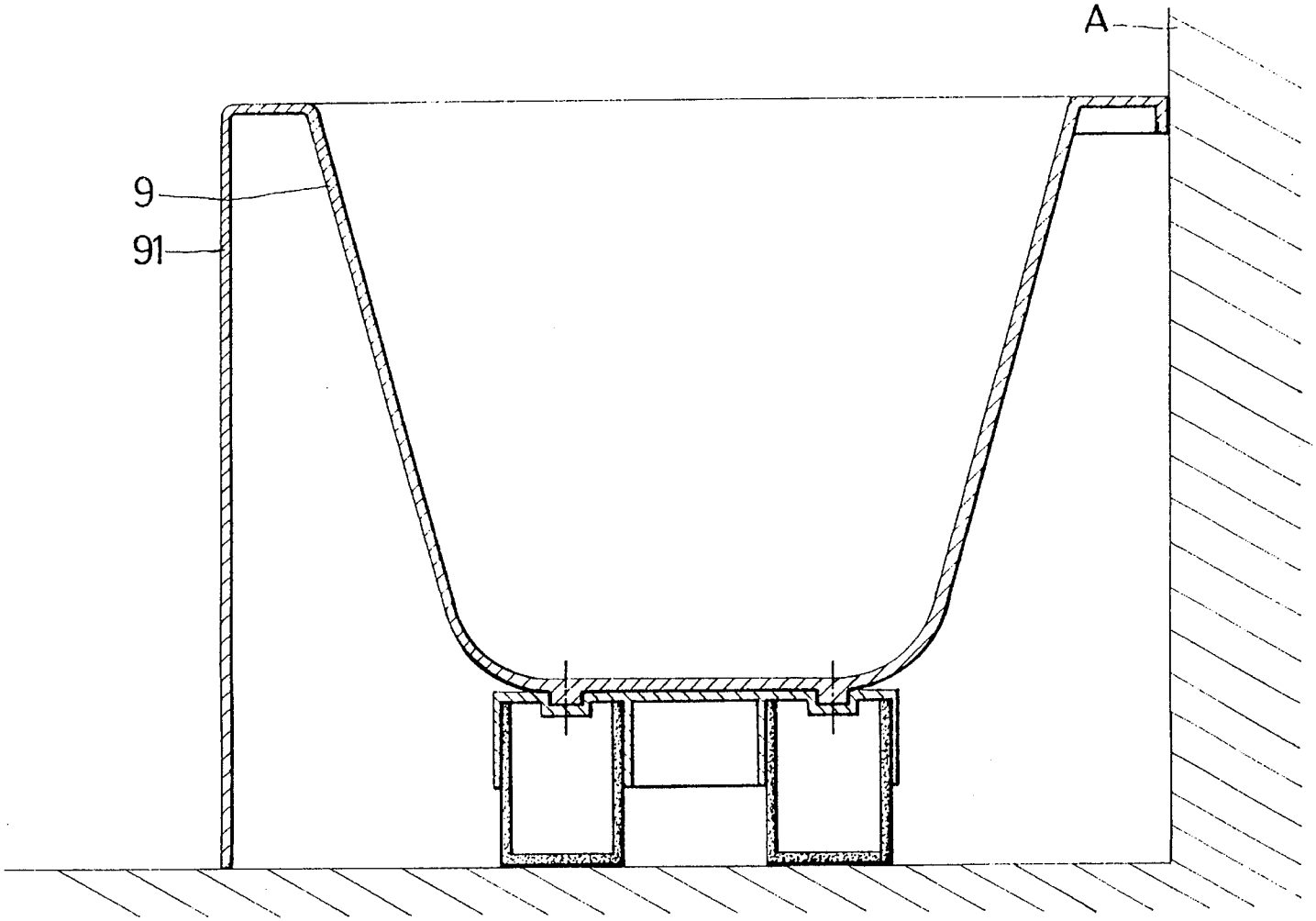
FIG. 1 PRIOR ART
FIG. 1 is a cross-sectional view of a conventional bathtub of the prior art.
Figure 2:
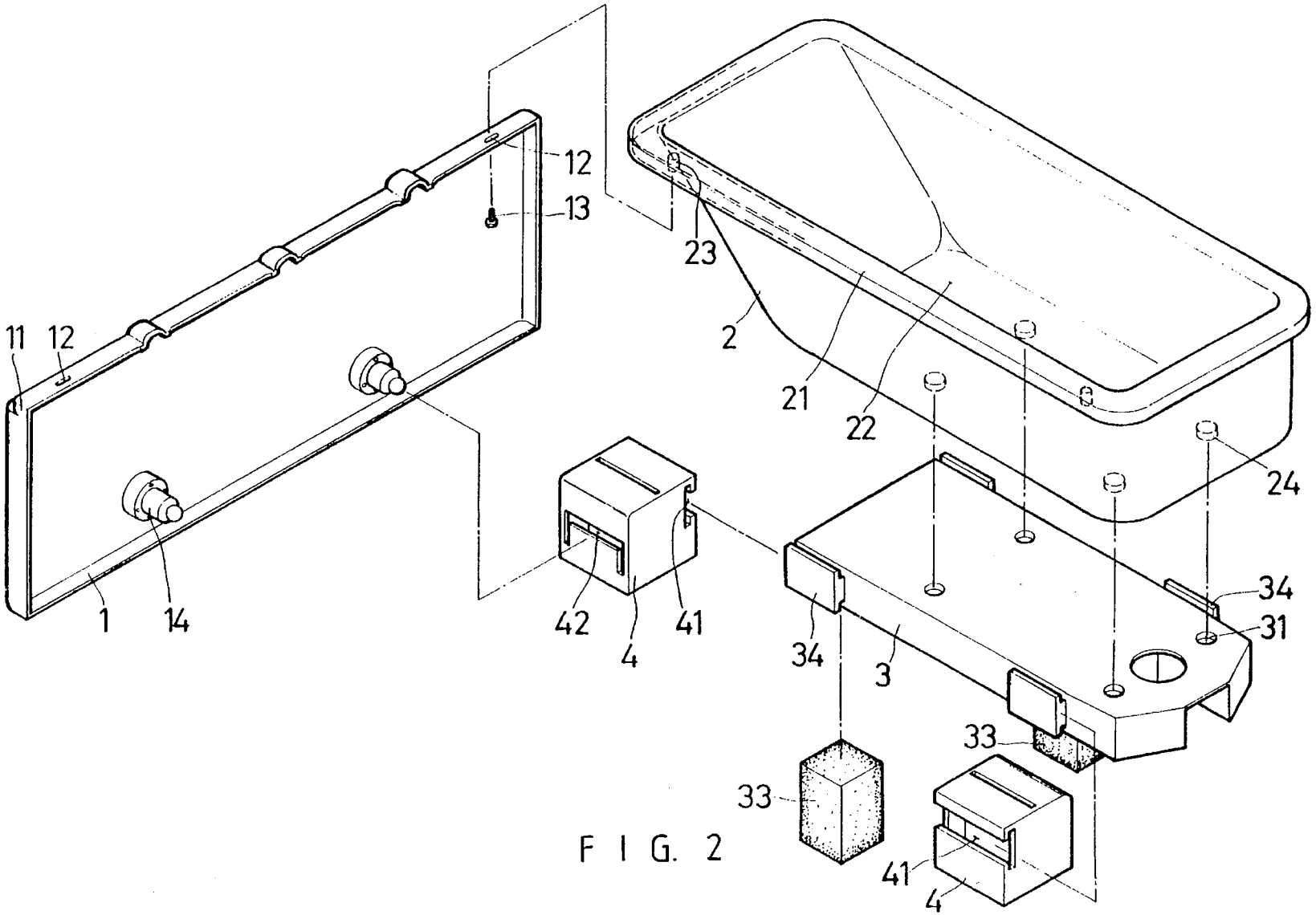
FIG. 2 is a perspective exploded view of a detachable bathtub of a preferred embodiment in accordance with the invention.
Figure 3:
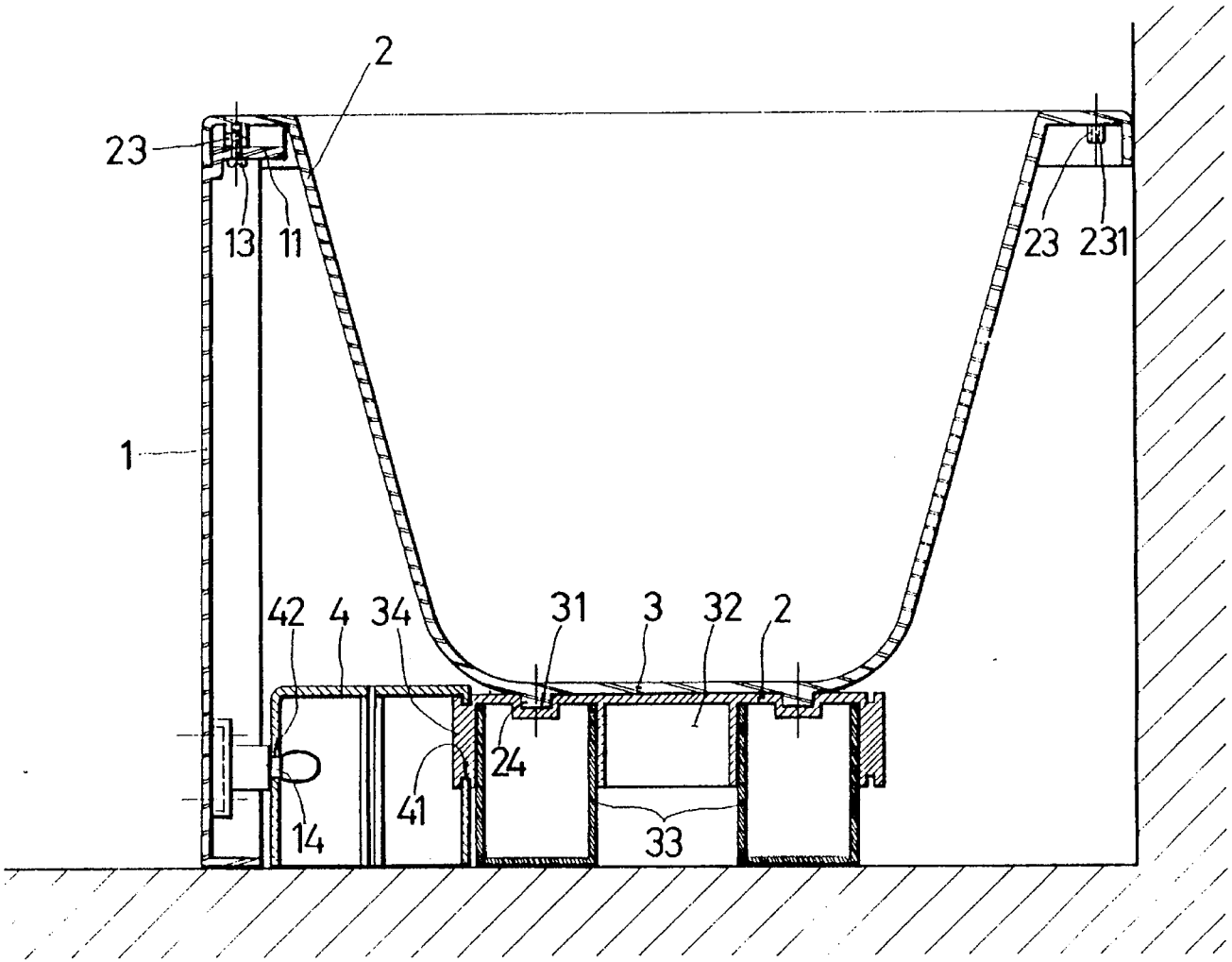
FIG. 3 is a cross-sectional view of a detachable bathtub of a preferred embodiment in accordance with the invention.

Referring to FIGS. 2 and 3, a detachable bathtub comprises a bathtub 2, a side board 1 abutting one side of the bathtub 2 vertically, and a base 3 disposed beneath the bathtub 2. The bathtub 2 has an upper flange 21 with a plurality of spaced posts 23 thereunder, an interior 22 to contain water, and a plurality of bulges 24 beneath the bathtub 2. Each post 23 has a central threaded hole 231. The side board 1 has a peripheral flange 11 with a plurality of spaced rectangular holes 12 thereon, and a plurality of spaced protrusions 14 disposed at the lower portion of the side board 1. The base 3 has a plurality of inserted holes 31 thereon, an elongated recess 32 thereunder, and a plurality of guide blocks 34 disposed at two sides of the base 3. The elongated recess 32 receives at least an adjusting block 33. The height of the block 33 can be varied according to the environmental condition of the bathroom. A plurality of supporting blocks 4 are disposed between the side board 1 and the base 3. Each of the supporting blocks 4 has a rectangular groove 41 on one side of the supporting block 4 and an inserted groove 42 on the opposite side of the supporting block 4. When the detachable bathtub is assembled, the adjusting block 33 is inserted in the elongated recess 32. The bulges 24 are inserted in the corresponding inserted holes 31. The guide blocks 34 are inserted in the corresponding rectangular grooves 41. The upper portion of the peripheral flange 11 is disposed beneath the upper flange 21. A screw 13 passes through the rectangular hole 12 and screw in the central threaded hole 231 of the post 23 to fasten the side board 1 and the bathtub 2 together. The protrusion 14 is pressed into the corresponding inserted groove 42 to fasten the side board 1 and the supporting block 4 together. Therefore, the side board 1 and the bathtub 2 are fastened stably.

The invention is not limited to the above embodiment but various modification thereof may be made. Further, various changes in form and detail may be made without departing from the scope of the invention.

I claim:

1. A detachable bathtub comprising:

a bathtub having an upper flange with a plurality of spaced posts under said upper flange, an interior and a plurality of bulges on a lower surface of said bathtub;

each of said posts having a central threaded hole;

a side board for supporting one side of said bathtub;

said side board having a peripheral flange with a plurality of spaced rectangular holes on said peripheral flange, and a plurality of spaced protrusions disposed at a lower portion of said side board;

a base disposed beneath said bathtub;

said base having a plurality of inserted holes thereon, an elongated recess thereunder, and a plurality of guide blocks disposed at two sides of said base;

said elongated recess receiving at least one adjusting block thereon;

at least one supporting block disposed between said side board and said base;

said at least one supporting block having a rectangular groove on one side of said supporting block and an inserted groove on an opposite side of said supporting block whereby said bulges are inserted into respective inserted holes;

at least one of said guide blocks is inserted into a respective rectangular groove;

an upper portion of said peripheral flange is disposed beneath said upper flange;

a screw passes through each said rectangular hole and screwing in said central threaded hole of said post to fasten said side board and said bathtub together; and at least one of said protrusions is pressed into a respective inserted groove to fasten said side board and said supporting block together.

* * * * *